US006686313B2

(12) United States Patent
Uyttendaele et al.

(10) Patent No.: US 6,686,313 B2
(45) Date of Patent: Feb. 3, 2004

(54) THERMOGRAPHIC RECORDING MATERIAL WITH IMPROVED IMAGE TONE

(75) Inventors: Carlo Uyttendaele, Mortsel (BE); Rene De Keyzer, Waasmunster (BE); Johan Loccufier, Zwijnaarde (BE); Ivan Hoogmartens, Wilrijk (BE)

(73) Assignee: Agfa-Gevaert (BE)

( * ) Notice: Subject to any disclaimer, the term of this patent is extended or adjusted under 35 U.S.C. 154(b) by 74 days.

(21) Appl. No.: 09/996,272

(22) Filed: Nov. 28, 2001

(65) Prior Publication Data

US 2002/0111270 A1 Aug. 15, 2002

Related U.S. Application Data

(60) Provisional application No. 60/257,450, filed on Dec. 21, 2000.

(30) Foreign Application Priority Data

Nov. 30, 2000 (EP) ..... 00204258

(51) Int. Cl.[7] ..... B41M 5/30

(52) U.S. Cl. ..... 503/201; 427/150; 427/152; 503/212

(58) Field of Search ..... 503/200, 212, 503/226, 201; 427/150, 152

(56) References Cited

U.S. PATENT DOCUMENTS 5,661,101 A 8/1997 Washizu et al.

5,686,228 A 11/1997 Murray et al.

FOREIGN PATENT DOCUMENTS

JP 07 248567 9/1995
WO WO 95/12495 5/1995

OTHER PUBLICATIONS

Search Report for EP 00 20 4258 dated May 29, 2001.

*Primary Examiner*—Bruce H. Hess
(74) *Attorney, Agent, or Firm*—Leydig, Voit & Mayer, Ltd.

(57) ABSTRACT

A monosheet black and white substantially light-insensitive thermographic recording material comprising a thermosensitive element and a support, the thermosensitive element containing a substantially light-insensitive organic silver salt and an organic reducing agent therefor in thermal working relationship therewith and a binder, wherein the thermographic recording material comprises a reaction product of an amino-group containing polymer and a compound according to formula (I):

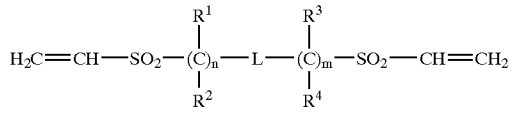

wherein each of $R^1$, $R^2$, $R^3$ and $R^4$ is independently hydrogen or an optionally substituted alkyl, aryl, heteroaryl, alkoxy or aryloxy group; L is a divalent linking group selected from the group consisting of oxygen and optionally substituted alkyl, aryl, heteroaryl, alkenyl and alkynyl groups; and m is either 0 or 1; and n is either 0 or 1; and a preparation process therefor.

11 Claims, No Drawings

THERMOGRAPHIC RECORDING MATERIAL WITH IMPROVED IMAGE TONE

CROSS-REFERENCE TO RELATED PATENT APPLICATIONS

The application claims the benefit of U.S. Provisional Application No. 60/257,450 filed Dec. 21, 2000, which is incorporated by reference. In addition, this application claims the benefit of European Application No. 204258.8, filed Nov. 30, 2000, which is also incorporated by reference.

FIELD OF THE INVENTION

The present invention relates to thermographic recording materials whose prints have improved archival properties.

BACKGROUND OF THE INVENTION

Thermal imaging or thermography is a recording process wherein images are generated by the use of thermal energy. In direct thermal thermography a visible image pattern is formed by image-wise heating of a recording material.

JN 07-248 567 discloses a thermosensitive recording material having a thermosensitive recording layer containing at least: a) an organic silver salt; b) a reducing agent; c) a water-soluble binder; d) a development accelerator such as phthalazinones; and e) a hardening agent for c). Included in a list of hardening agents as particularly preferred were the compounds 1,3,5-triacryloyl-hexahydro-s-triazine and 1,2-bis vinylsulfonylmethane, 1,3-bis(vinylsulfonylmethyl) propanal-2, bis(α-vinyl sulfonyl acetoamido)ethane, 2,4-dichloro-6-hydroxy-s-triazine/sodium salt, 2,4,6-triethylene imino-s-triazine, boric acid etc., the added amount being preferably 0.5–5 wt % with respect to the water-soluble binder. However, only bis(α-vinyl sulfonyl acetoamido) ethane, $CH_2{=}CH{-}SO_2{-}CH_2{-}CONHCH_2{-}CH_2{-}NH{-}COCH_2{-}SO_2{-}CH{=}CH_2$, was an ingredient in the thermosensitive recording layers of the examples, it being present in the thermosensitive recording layer of example 1 together with the reducing agents bisphenol B and propyl gallate, gelatin and silver behenate.

In printing with thermographic materials for medical applications for viewing with a light box, optimum diagnosis requires a blue-black image tone so that the higher ability of the human eye to distinguish detail with such image tone can be exploited, thereby improving the diagnostic value of such prints. Such image tone should be independent of the shelf life of the thermographic recording material prior to printing and also of archival time after printing. Image tone can be assessed on the basis of the L*, a* and b* CIELAB-values as determined by spectrophotometric measurements according to ASTM Norm E179-90 in a R(45/0) geometry with evaluation according to ASTM Norm E308-90. The mechanical stresses which thermographic recording materials undergo during the thermal printing process require the use of hardened polymers and hence of hardening agents to harden the polymers. However, such hardening agents not only harden the polymer, but can also have a prohibitive effect on image tone, which is undesirable. There is therefore a need for hardening agents and polymer-hardening agent systems for hardening thermographic recording materials, which have substantially no effect on the image tone of prints produced with such hardened thermographic recording materials.

It is therefore an object of the present invention to provide a hardener for substantially light-insensitive black and white thermographic recording materials containing an organic silver salt, a reducing agent therefor in thermal working relationship therewith and an amino-group-containing polymer, which produces adequate hardening of the amino-group-containing polymer, while not substantially affecting the image tone or image tone stability of thermographic prints produced therewith.

Further objects and advantages of the invention will become apparent from the description hereinafter.

BRIEF SUMMARY OF THE INVENTION

Since divinylsulfone compounds are well-known hardeners for amino-group-containing polymers, it would be expected that all divinylsulfone compounds would be equally effective as hardeners of amino-group-containing polymers in substantially light-insensitive thermographic recording materials, see JN 07-248 567. However, it has been surprisingly found that only substantially light-insensitive thermographic recording materials comprising amino-group-containing polymers hardened with particular divinylsulfone compounds are capable of providing prints whose image tone is substantially unaffected by the divinylsulfone compound used, whereas prints produced with thermographic recording materials hardened with other divinylsulfone compounds exhibit image tones which have been substantially affected by the divinylsulfone compound used.

The above mentioned objects are realized by providing a monosheet black and white substantially light-insensitive thermographic recording material comprising a thermosensitive element and a support, the thermosensitive element containing a substantially light-insensitive organic silver salt, an organic reducing agent therefor in thermal working relationship therewith and a binder, wherein the thermographic recording material comprises a reaction product of an amino-group containing polymer and a compound according to formula (I):

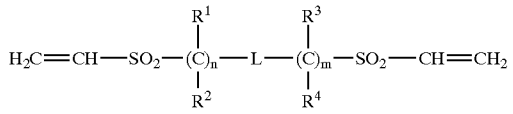

wherein each of $R^1$, $R^2$, $R^3$ and $R^4$ is independently hydrogen or an optionally substituted alkyl, aryl, heteroaryl, alkoxy or aryloxy group; L is a divalent linking group selected from the group consisting of oxygen and optionally substituted alkyl, aryl, heteroaryl, alkenyl and alkynyl groups; and m is either 0 or 1; and n is either 0 or 1.

A process is also provided by the present invention for coating a support with the above-described thermosensitive element comprising the steps of: applying a solution or dispersion containing the compound according to formula (I) to a support; and reacting the compound according to formula (I) with an amino-group-containing polymer, the compound according to formula (I) and the amino-group-containing polymer being either in the same layer or in immediately adjacent layers.

Use is also provided by the present invention of a compound according to formula (I):

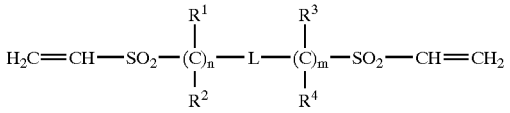

wherein each of $R^1$, $R^2$, $R^3$ and $R^4$ is independently hydrogen or an optionally substituted alkyl, aryl, heteroaryl, alkoxy or aryloxy group; L is a divalent linking group selected from the group consisting of oxygen and optionally substituted alkyl, aryl, heteroaryl, alkenyl and alkynyl groups; and m is either 0 or 1; and n is either 0 or 1, in the preparation of thermographic recording materials containing a substantially light-insensitive organic silver salt.

A thermographic imaging process comprising the steps of: providing the above-described monosheet black and white substantially light-insensitive thermographic recording material; and image-wise applying heat to said thermographic recording material under substantially water-free conditions.

Preferred embodiments are disclosed in the dependent claims.

DETAILED DESCRIPTION OF THE INVENTION

In a preferred embodiment of the thermographic recording process, according to the present invention, the heat source is a thermal head with a thin film thermal head being particularly preferred.

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

By substantially light-insensitive is meant not intentionally light sensitive.

The term thermographic recording material includes substantially light-insensitive thermographic recording materials and photothermographic recording materials in which a photosensitizing material such as photosensitive silver halide is present in the thermosensitive element.

Heating in a substantially water-free condition as used herein, means heating at a temperature of 80 to 250° C. The term "substantially water-free condition" means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

Compounds according to formula (I):

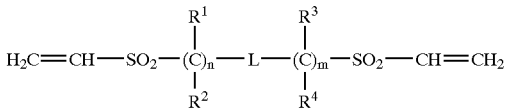

are used in the thermoplastic recording materials of the present invention, wherein each of $R^1$, $R^2$, $R^3$ and $R^4$ is independently hydrogen or an optionally substituted alkyl, aryl, heteroaryl, alkoxy or aryloxy group; L is a divalent linking group selected from the group consisting of oxygen and optionally substituted alkyl, aryl, heteroaryl, alkenyl and alkynyl groups; and m is either 0 or 1; and n is either 0 or 1.

Preferred substituents of the alkyl, aryl, heteroaryl, alkenyl and alkynyl groups representing L are alkyleneoxyalkyl, alkyl, aryl, sulphonylvinyl, hydroxy, alkoxy and aryloxy groups. Preferred substituents of the alkyl, aryl, heteroaryl, alkoxy or aryloxy groups representing the $R^1$ to $R^4$ groups are alkyleneoxyalkyl, alkyl, aryl, sulphonylvinyl, hydroxy, alkoxy and aryloxy groups.

L is preferably an alkylene group, an alkyleneoxyalkylene group, an alkylene group substituted with at least one hydroxy-group, an alkylene group substituted with at least one methylene-sulphonylvinyl-group, an alkyleneoxyalkyl-substituted alkyl group, an oxyalkyleneoxyalkyl-substituted alkyl group, a phenylene group, a carboxy-substituted alkyl group, a carboxyalkyl-substituted alkyl group, an acyloxy-substituted alkyl group and a 3,5-dihydrodioxole group.

Suitable compounds according to formula (II) for use in the substantially light-insensitive thermographic recording materials of the present invention are compounds DVS-1 to DVS-18 below:

| Compound | Structure |
|---|---|
| DVS-1 | 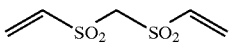 |
| DVS-2 | 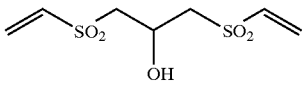 |
| DVS-3 | 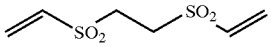 |
| DVS-4 | 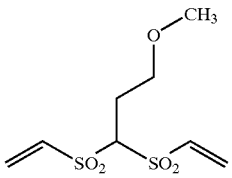 |
| DVS-5 | 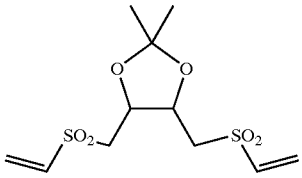 |
| DVS-6 | 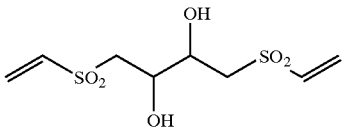 |
| DVS-7 | 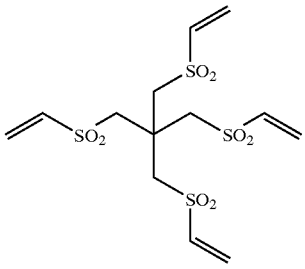 |

-continued

| Compound | Structure |
|---|---|
| DVS-8 | 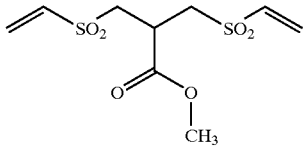 |
| DVS-9 | 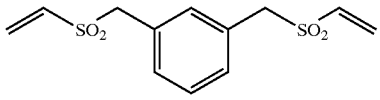 |
| DVS-10 | 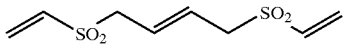 |
| DVS-11 | 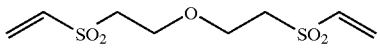 |
| DVS-12 | 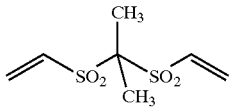 |
| DVS-13 | 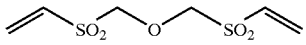 |
| DVS-14 | 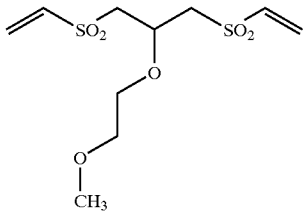 |
| DVS-15 | 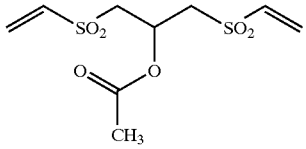 |
| DVS-16 | 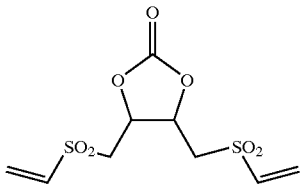 |
| DVS-17 | 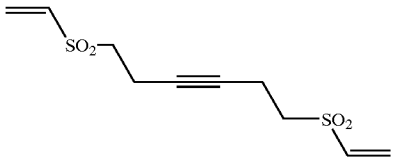 |
| DVS-18 | 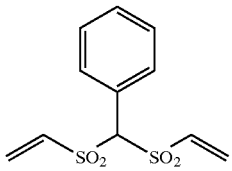 |

Preferred compounds according to formula (I) are compounds according to formula (II):

$$CH_2{=}CH{-}SO_2{-}R{-}SO_2{-}CH{=}CH_2$$

wherein R is a hydrocarbon group optionally substituted with an oxygen atom, the hydrocarbon group being optionally substituted with at least one alkoxy, alkyl, sulphonylvinyl or alkyleneoxyalkyl group, R being preferably a hydrocarbon group with 1 to 6 carbon atoms.

Particularly preferred compounds according to formula (I) are selected from the group consisting of: 1,1-bis-(vinylsulfonyl)-methane (DVS-1), 1,2-bis-(vinylsulfonyl)-ethane (DVS-3), 1,2-bis-(vinylsulfonyl)propane, 1,3-bis-(vinylsulfonyl)propane, 1,3-bis-(vinylsulfonyl)-2-hydroxy-propane (DVS-3), 3,3-bis-(vinylsulfonyl)-n-propyl-methyl-ether (DVS-4), tetrakis-(vinylsulphonylmethylene)-methane (DVS-7) and 1,5-bis-(vinylsulfonyl)-3-oxy-n-pentane (DVS-11).

The thermosensitive element as used herein is that element which contains all the ingredients which contribute to image formation. According to the present invention the thermosensitive element, contains a substantially light-insensitive organic silver salt, an organic reducing agent therefor in thermal working relationship therewith and a binder. The element may comprise a layer system in which the above-mentioned ingredients may be dispersed in different layers, with the proviso that the substantially light-insensitive organic silver salt is in reactive association with the reducing agent i.e. during the thermal development process the reducing agent must be present in such a way that it is able to diffuse to the particles of substantially light-insensitive organic silver salt so that reduction to silver can occur.

The thermosensitive element may optionally contain a reaction product of an amino-group-containing polymer and a compound according to formula (I). Furthermore, in a preferred embodiment of the thermographic recording material of the present invention, the reaction product of an amino-group-containing polymer and a compound according to formula (I) is substantially present in the thermosensitive element.

Preferred organic silver salts for use in the thermographic recording materials of the present invention are substantially light-insensitive silver salts of an organic carboxylic acid. Preferred substantially light-insensitive silver salts of an organic carboxylic acid are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques e.g. using ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and a more finely ground dispersions of organic silver salts.

Suitable organic reducing agents for the reduction the substantially light-insensitive organic silver salt are organic compounds containing at least one active hydrogen atom linked to O, N or C, such as is the case with, aromatic di- and tri-hydroxy compounds. 1,2-dihydroxybenzene derivatives, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred, with those described in EP-B 692 733, e.g. ethyl 3,4-dihydroxybenzoate and n-butyl 3,4-dihydroxybenzoate, and EP-A 903 625, e.g. 3,4-dihydroxybenzonitrile, being particularly preferred.

Combinations of reducing agents may also be used that on heating become reactive partners in the reduction of the substantially light-insensitive organic silver salt containing mixed crystals of two or more organic silver salts. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5,545,507 and 5,558,983; acrylonitrile compounds as disclosed in U.S. Pat. Nos. 5,545,515 and 5,635,339; and 2-substituted malonodialdehyde compounds as disclosed in U.S. Pat. No. 5,654,130.

In a preferred embodiment of the present invention each and every reducing agent in said thermosensitive element is a 1,2-dihydroxybenzene derivative.

In a preferred embodiment of the thermographic recording material according to the present invention the amino-group-containing polymer is selected from the group consisting of natural and synthetic polymers. Suitable natural polymers include gelatin and gelatin derivatives. Suitable synthetic polymers include melamine-formaldehyde resins, melamine-poly(vinyl alcohol) reaction products, aniline-formaldehyde resins and urea-formaldehyde resins. Polymer latex particles with surface amino groups were disclosed online on Oct. 17, 2000 by I. Miraballes-Martinez and J. Forcada in Journal of Polymer Science: Part A: Polymer Chemistry, volume 38, pages 4230–4237, herein incorporated by reference. Such latex particles were prepared by a two-step emulsion polymerization, in the first step, the seeds were synthesized by batch emulsion polymerization of styrene; and in the second step, two different amino-functionalized monomers, two different initiator systems ($K_2S_2O_8$ and $K_2S_2O_8/NaS_2O_5$ and mixtures of emulsifiers sodium dodecylsulfate and Tween™ 21 were used to synthesize the final latexes.

The binder of the thermosensitive element and/or the binder of a protective layer may, according to the present invention, comprise a reaction product of an amino-group containing polymer and a compound according to formula (I).

The film-forming binder of the thermosensitive element may be all kinds of natural, modified natural or synthetic resins or mixtures of such resins, in which the substantially light-insensitive organic silver salt can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

Binders are preferred which do not contain additives or impurities which adversely affect the thermographic properties of the thermographic recording materials in which they are used.

In order to obtain a neutral black image tone in the higher densities and neutral grey in the lower densities, the thermosensitive element preferably further contains a so-called toning agent.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toning compounds of the benzoxazine dione or naphthoxazine dione type as disclosed in GB 1,439,478, U.S. Pat. Nos. 3,951,660 and 5,599,647.

Stabilizers may be incorporated into the substantially light-insensitive thermographic recording materials of the present invention in order to obtain improved shelf-life and reduced fogging.

Preferred stabilizers are a compound according to formula (I):

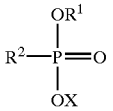

(I)

wherein $R^1$ is hydrogen, an alkali metal ion, an ammonium ion, a phosphonium ion, a sulphonium ion, an alkaline earth ion or an aryl, substituted aryl, alkyl or substituted alkyl group; $R^2$ is an alkyl, substituted alkyl, alkaryl, substituted alkaryl, aralkyl, substituted aralkyl, aryl, substituted aryl group, heteroaryl or substituted heteroaryl group; and X is hydrogen, an alkali metal ion, an ammonium ion or an alkaline earth ion.

Other preferred stabilizers are sterically hindered monophenols; benzotriazole; substituted benzotriazoles; tetrazoles; mercaptotetrazoles, such as 1-phenyl-5-mercapto-tetrazole; and aromatic polycarboxylic acids, such as ortho-phthalic acid, 3-nitro-phthalic acid, tetrachlorophthalic acid, mellitic acid, pyromellitic acid and trimellitic acid, and anhydrides thereof.

Particularly preferred stabilizers are 3,5-di-tert-butyl-4-hydroxybenzoic acid, 2-phosphono-1,2,3-propanetricarboxylic acid, the calcium salt of 4-ethylphosphomethyl-2,5-di-t-butylphenol, benzotriazole, 1-phenyl-5-mercapto-tetrazole, tetrachlorophthalic acid and tetrachlorophthalic acid anhydride.

According to the substantially light-insensitive thermographic recording material of the present invention the thermosensitive element may comprise in addition at least one optionally substituted polycarboxylic acid and/or anhydride thereof in a molar percentage of at least 15 with respect to all the organic silver salt(s) present and in thermal working relationship therewith. The polycarboxylic acid may be aliphatic (saturated as well as unsaturated aliphatic and also cycloaliphatic) and may be used in anhydride form or partially esterified on the condition that at least two free carboxylic acids remain or are available in the heat recording step.

Surfactants and dispersants aid the dispersion of ingredients or reactants which are insoluble in the particular dispersion medium. The thermographic recording materials of the present invention may contain one or more surfactants, which may be anionic, non-ionic or cationic surfactants and/or one or more dispersants.

The recording material may contain in addition to the ingredients mentioned above other additives such as antistatic agents, e.g. non-ionic antistatic agents including a fluorocarbon group as e.g. in $F_3C(CF_2)_6CONH(CH_2CH_2O)$—H, silicone oil, e.g. BAYSILON™ MA (from BAYER AG, GERMANY).

The support for the thermosensitive element according to the present invention may be transparent, translucent or opaque and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if need be to improve the adherence to the thereon coated thermosensitive element. It may be pigmented with a blue pigment as so-called blue-base. One or more backing layers may be provided to control physical properties such as curl and static.

According to a preferred embodiment of the recording material, according to the present invention, the thermosensitive element is provided with a protective layer to avoid local deformation of the thermosensitive element and to improve resistance against abrasion. In a particularly preferred embodiment of the thermographic recording material of the present invention, the reaction product of the amino-group-containing polymer and the compound according to formula (I) is substantially present in the protective layer.

The protective layer preferably comprises a binder, which may be solvent-soluble, solvent-dispersible, water-soluble or water-dispersible. Among the solvent-soluble binders polycarbonates as described in EP-A 614 769 are particularly preferred. However, water-soluble or water-dispersible binders are preferred for the protective layer, as coating can be performed from an aqueous composition and mixing of the protective layer with the immediate underlayer can be avoided by using a solvent-soluble or solvent-dispersible binder in the immediate underlayer. The protective layer according to the present invention may be crosslinked. Crosslinking can be achieved by using crosslinking agents such as described in WO 95/12495. Solid or liquid lubricants or combinations thereof are suitable for improving the slip characteristics of the thermographic recording materials according to the present invention. Preferred solid lubricants are thermomeltable particles such as those described in WO 94/11199. The protective layer of the thermographic recording material according to the present invention may comprise a matting agent. Preferred matting agents are described in WO 94/11198, e.g. talc particles, and optionally protrude from the protective layer.

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic imaging is carried out under substantially water-free conditions by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating-time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated. The ingredients used in the invention and comparative examples, are:

Thermosensitive element:

organic silver salts:
- AgB=silver behenate;

reducing agent:
- R01=ethyl 3,4-dihydroxybenzoate;
- R02=3,4-dihydroxybenzonitrile;

binders:
- LATEX01=a copolymer consisting of 54.25 wt. % styrene, 43.25 wt. % butyl acrylate and 2.5 wt. % potassium salt of N-[(4'-sulfobenzamido)-oxo-decyl] meth-acrylamide;

amino-group-containing polymers:
- K17881=type 17881, a gelatin with low potassium ion, sodium ion and chloride-ion concentrations from AGFA-GEVAERT GELATINEFABRIEK;
- R13311=type 13311, a calcium-containing low viscosity gelatin from Rousselot;
- R16875=type 16875, a phthaloyl-gelatin from Rousselot;

hardening agents according to the present invention:
- DVS-1;
- DVS-4;

hardening agents outside the scope of the present invention:

CHA01=formaldehyde;

CHA02=1,3-glutaardialdehyde;

CHA03=bis(α-vinylsulfonylacetamido)ethane, $CH_2{=}CH\text{-}SO_2{-}CH_2{-}CONH{-}CH_2{-}CH_2{-}NHOC{-}CH_2{-}SO_2{-}CH{=}CH_2$;

stabilizers:

S01=1-phenyl-5-mercapto-tetrazole;

Surfactant No. 1=MARLON™ A-365, supplied as a 65% concentrate of a sodium alkyl-phenylsulfonate by HÜLS;

Surfactant No. 2=MARLON™ AS3, supplied as a 98% concentrate of an alkylphenylsulfonic acid by HÜLS;

toning agents:

T01=7-(ethylcarbonato)-benzo [e][1,3]oxazine-2,4-dione;

T02=phthalazinone.

Protective layer:

Polyviol™ 48 20=a polyvinylalcohol, from Wacker Chemie;

purified polyvinyl alcohol=Polyviol™ WX 48 20 purified by extraction with methanol/water (75/25 by volume);

Surfactant No. 3=HOSTAPAL™ BV, supplied as a 50% concentrate of a sodium trisalkylphenyl-polyethylene glycol(EO 7-8) sulphate by HOECHST;

Surfactant No. 4=GALORYL™ MT806L supplied as a 37% aqueous solution by CFPI;

SYLOID™ 244=a porous silica, from Grace;

MICROACE™ type P3=an Indian talc from Nippon Talc;

SERVOXYL™ VPAZ 100=a mixture of monolauryl and dilauryl phosphate, from Servo Delden B.V.;

SERVOXYL™ VPDZ 3/100=a mono[isotridecyl polyglycolether (3EO)] phosphate, from Servo Delden B.V.;

RILANIT™ GMS=glycerine monotallow acid ester, from Henkel AG;

LEVASIL™ 500=a 15% aqueous dispersion of colloidal silica with acid groups substantially neutralized with sodium ions and a specific surface area of 500 $m^2/g$, from Bayer AG RESIMENE™ AQ-7550=78% aqueous solution of a high solids, partially methylated melamine formaldehyde crosslinking resin solution from Monsanto Backing layer:

K16096=type 16096 gelatin from Agfa-Gevaert Gelatinfabriek;

R13311=type 13311 low viscosity calcium-containing gelatin from Rousselot;

Surfactant No. 5=octyl-phenyl-oxy-polyethylene-glycol (EO 8)acetic acid;

Surfactant No. 6=ammonium salt of perfluoro-octanoic acid.

The following examples are included to demonstrate specific embodiments of the invention. It should be appreciated by those of skill in the art that the techniques disclosed in the examples which follow represent techniques discovered by the inventors to effectively function in the practice of the invention, and thus can be considered to constitute exemplary modes for its practice. However, those of skill in the art should, in light of the present disclosure, appreciate that many changes can be made in the specific embodiments which are disclosed and still obtain a like or similar result without departing from the spirit and scope of the invention.

COMPARATIVE EXAMPLES 1 TO 8 AND INVENTION EXAMPLES 1 TO 4

Preparation of Silver Behenate Dispersions

The silver behenate dispersion used in COMPARATIVE EXAMPLES 1 to 8 and INVENTION EXAMPLES 1 to 4 was produced as follows: 25 kg (73.5M) behenic acid was dispersed with stirring at 80° C. in 100 L of a 10% solution of Surfactant No. 1 per g behenic acid made up to 250 L with deionized water at a temperature of 80° C.; then 36.75 L of a 2 M aqueous solution of sodium hydroxide was added over a period of 10 to 20 minutes to give a clear solution substantially containing sodium behenate; then 25 L of a 2.94 M aqueous solution of silver nitrate was added with stirring at a rate of 0.163 moles/moles silver behenate min to convert the sodium behenate completely into silver behenate; and finally ultrafiltration was carried out with a 500000 MW polysulfone cartridge filter at room temperature to concentrate the resulting silver behenate dispersion while adding ammonium nitrate to convert Surfactant No. 1 into its ammonium salt, the final AgBeh-concentration was 20.4% with 0.062 g of ammonium alkyl-phenylsulfonate/g AgBeh, the residual conductivity was 1.0 mS/cm.

Support Provided with a Backing Layer

The support was a subbed 168 μm thick blue-pigmented polyethylene terephthalate support. One side of the subbed support was coated with an aqueous dispersion containing 10.05% by weight of K16096, 0.08% by weight of a 6 μm poly(methyl methacrylate) matting agent, 0.07% by weight of R13311, 0.1% by weight of Surfactant No 5, 0.026% by weight of Surfactant No 6 and 0.32% by weight of DVS-1 to produce a layer with the following composition:

| | |
|---|---|
| K16096: | 2.73 $g/m^2$ |
| 6 μm poly(methyl methacrylate) matting agent: | 0.025 $g/m^2$ |
| R13311: | 0.022 $g/m^2$ |
| Surfactant No. 5: | 0.03 $g/m^2$ |
| Surfactant No. 6: | 0.008 $g/m^2$ |
| DVS-1: | 0.10 $g/m^2$ |

The optical density upon measurement with a MACBETH™ TR924 densitometer through visible and blue filters in transmission of subbed support with backing layer was 0.19 and 0.05 respectively. Furthermore, it had a* and b* values of −7.9 and −16.6 respectively.

Preparation of Thermographic Recording Materials

The coating dispersion for the thermosensitive element was produced by first allowing 3.44 g of K17881 to swell in 16.31 g of deionized water over a period of 30 minutes. 0.7 g of a first aqueous toning agent dispersion containing 20% of T01 and 12.5% of K17881 and 1.925 g of a second toning agent dispersion containing 20% of T02 and 10% of R16875 were then added and the resulting dispersion heated with stirring up to 50° C. 2 g of the above-mentioned dispersion of silver behenate were then added and after 10 minutes stirring a further 22.2 g of the same silver behenate dispersion were added and the resulting dispersion stirred for a further 10 minutes before 3.955 g of a 25.28% dispersion of LATEX01 was added. After a further 10 minutes stirring 2.222 g of 6% poly(itaconic acid) in water was added and after a further 10 minutes stirring, the resulting dispersion was cooled to 36° C. Finally, 18.38 g of deionized water was added. Shortly before coating 6 g of an aqueous ethanol solution containing 9.909% of R02 and 4.9% of S01 was added with stirring.

This coating dispersion at a temperature of 36° C. was then doctor-blade coated onto the non-backing layer side of the above-mentioned subbed 168 μm thick blue-polyethylene pigmented polyethylene terephthalate support to a wet coating weight of 72 g/m$^2$ and while undried was overcoated with 11 g/m$^2$ of an aqueous solution containing a hardener (see Table 1 for hardener type and concentration in the aqueous solution) and 0.9091% by weight of Surfactant No. 1. Upon drying, the thermosensitive elements of COMPARATIVE EXAMPLES 1 to 4 and INVENTION EXAMPLES 1 and 2 were obtained.

TABLE 1

| | Hardener | | % by weight hardener |
|---|---|---|---|
| | type | % by wt in aqueous solution | vs polymer in thermo-sensitive amino- group-containing element |
| Comparative Example No | | | |
| 1 | — | — | — |
| 2 | CHA01 | 1.82 | 6.1 |
| 3 | CHA02 | 0.45 | 1.5 |
| 4 | CHA03 | 1.82 | 6.1 |
| Invention Example No | | | |
| 1 | DVS-1 | 1.82 | 6.1 |
| 2 | DVS-4 | 1.82 | 6.1 |

Protective Layer

The thermosensitive elements of the thermographic recording materials of COMPARATIVE EXAMPLES 1 to 4 and INVENTION EXAMPLES 1 and 2 were coated with an aqueous dispersion with the following ingredients which upon drying produced a protective layer with the following composition:

| | |
|---|---|
| Surfactant No. 3 | 0.047 g/m$^2$ |
| Purified poly(vinyl alcohol) | 2.43 g/m$^2$ |
| SYLOID ™ 244 | 0.067 g/m$^2$ |
| SERVOXYL ™ VPDZ 3/100 | 0.074 g/m$^2$ |
| SERVOXYL ™ VPAZ 100 | 0.074 g/m$^2$ |
| MICROACE ™ P3 | 0.064 g/m$^2$ |
| RILANIT ™ GMS | 0.053 g/m$^2$ |
| LEVASIL ™ 500 (converted from sodium into ammonium form) by ion exchange | 1.00 g/m$^2$ |
| p-toluene sulfonic acid | 0.057 g/m$^2$ |
| Surfactant No. 2 | 0.021 g/m$^2$ |
| Surfactant No. 4 | 0.007 g/m$^2$ |
| RESIMENE ™ AQ-7550 | 0.350 g/m$^2$ |

thereby producing the thermographic recording materials of COMPARATIVE EXAMPLES 1 to 4 and INVENTION EXAMPLES 1 and 2.

Thermographic Printing

The thermographic recording materials of COMPARATIVE EXAMPLES 1 to 4 and INVENTION EXAMPLES 1 and 2 were printed using a DRYSTAR® 2000 printer from AGFA-GEVAERT equipped with a thin film thermal head with a resolution of 300 dpi and operated with a line time of 11.8 ms (the line time being the time needed for printing one line). During this line time the print head received constant power. The printing power was 90 mW and the thermal head resistors were time-modulated to produce different image densities.

The maximum densities of the images ($D_{max}$) measured through a visible filter with a MACBETH™ TR924 densitometer in the grey scale step corresponding to a data level of 64 are given in Table 2 for COMPARATIVE EXAMPLES 1 to 4 and INVENTION EXAMPLES 1 and 2.

Image Evaluation

The image tone of fresh prints made with the substantially light-insensitive thermographic recording materials of COMPARATIVE EXAMPLES 1 to 4 and INVENTION EXAMPLES 1 and 2 was assessed on the basis of the L*, a* and b* CIELAB-values. The L*, a* and b* CIELAB-values were determined by spectrophotometric measurements according to ASTM Norm E179-90 in a R(45/0) geometry with evaluation according to ASTM Norm E308-90. The a* and b* CIELAB-values of fresh prints of the substantially light-insensitive thermographic recording materials of COMPARATIVE EXAMPLES 1 to 4 and INVENTION EXAMPLES 1 and 2 at optical densities, D, of 1.0 are given in Table 2.

In the CIELAB-system a negative CIELAB a*-value indicates a greenish image-tone becoming greener as a* becomes more negative, a positive a*-value indicating a reddish image-tone becoming redder as a* becomes more positive. A negative CIELAB b*-value indicates a bluish tone which becomes increasingly bluer as b* becomes more negative and a positive b*-value indicates a yellowish image-tone becoming more yellow as b* becomes more positive. In terms of the visual perception of an image as a whole, the image tone of elements of the image with a density of 1.0 have a stronger effect than the image tone of elements with lower or higher optical.

TABLE 2

| | AgB | Hard- | Print with fresh material | | CIELAB-values for D = 1 for print with fresh material | |
|---|---|---|---|---|---|---|
| | g/m$^2$ | ener | $D_{max}$ vis | $D_{min}$ vis | a* | b* |
| Comparative Example No. | | | | | | |
| 1 | 4.85 | — | 2.26 | 0.20 | −5.2 | −5.1 |
| 2 | 5.11 | CHA01 | 3.04 | 0.20 | −6.4 | −2.9 |
| 3 | 4.85 | CHA02 | 3.62 | 0.20 | −6.8 | −1.1 |
| 4 | 4.95 | CHA03 | 2.43 | 0.20 | −5.7 | −4.9 |
| Invention Example No | | | | | | |
| 1 | 4.79 | DVS-1 | 2.49 | 0.20 | −5.4 | −5.1 |
| 2 | 4.85 | DVS-4 | 2.43 | 0.20 | −5.6 | −4.9 |

The CIELAB-values for prints made with fresh materials were comparable for the thermographic recording materials of COMPARATIVE EXAMPLES 1 and 4 and INVENTION EXAMPLES 1 and 2, but those for the thermographic recording materials of COMPARATIVE EXAMPLES 3 and 4 have insufficiently negative b* values, when the b* value without coating has a b* value of −16.6. The $D_{min}$ values are mainly due to the density of the support, which had a $D_{vis}$ value of 0.19.

Archivability Tests

Simulated long-term archivability tests were performed by heating prints produced with thermographic recording materials of COMPARATIVE EXAMPLES 1 to 4 and INVENTION EXAMPLES 1 and 2, which had been subjected to heating at 45° C. in 70% relative humidity in the dark for 3 days prior to printing, for 4 days in the dark at 45°

C. and 70% relative humidity. The prints were then evaluated as described above for prints of the corresponding fresh thermographic recording materials and the results are given in Table 3.

Archival performance was assessed by monitoring the changes in a* and b* CIELAB values at D=1 of a print produced with a sheet of thermographic recording material, which had been heated in the dark for 3 days at 45° C. and 70% relative humidity prior to printing, over 4 days in the dark at 45° C. and 70% relative humidity. Acceptable shelf-life behaviour is represented by Δa* and Δb* CIELAB values at D=1 which represent lower a*- and b*-shifts together with acceptable final a*- and b*-values i.e. sufficiently negative b*-values.

TABLE 3

| | Print* after 4d 45°/70% RH | | CIELAB-values for print* after 4d 45° C./70% RH | | ΔCIELAB-values versus fresh print | |
|---|---|---|---|---|---|---|
| | $D_{max}$ | $D_{min}$ | for D = 1 | | for D = 1 | |
| | vis | vis | a* | b* | Δa* | Δb* |
| Comparative Example No | | | | | | |
| 5 | 2.88 | 0.20 | +5.4 | +4.3 | +10.6 | +9.4 |
| 6 | 3.59 | 0.20 | +4.1 | +3.8 | +10.5 | +6.7 |
| 7 | 4.21 | 0.19 | +6.1 | +6.5 | +12.9 | +7.6 |
| 8 | 3.05 | 0.20 | +5.1 | +4.1 | +10.8 | +9.0 |
| Invention Example No. | | | | | | |
| 3 | 3.05 | 0.20 | +1.9 | +0.4 | +7.3 | +5.5 |
| 4 | 3.12 | 0.19 | +0.7 | −2.8 | +6.3 | +2.1 |

*material subjected to 3d at 45° C./70% RH prior to printing

It is clear from Table 3 that both the absolute values of b* observed after the archival test for the thermographic recording materials with hardening agents outside the scope of the present invention of COMPARATIVE EXAMPLES 1 to 4 and the Δa* and Δb* values are prohibitively positive and large respectively. Furthermore, the absolute values of b* observed after the archival test for the thermographic recording materials with hardening agents according to the present invention of INVENTION EXAMPLES 1 and 2 and the Δa* and Δb* values are acceptable and much smaller than those for the thermographic recording materials of COMPARATIVE EXAMPLES 1 to 4, respectively.

INVENTION EXAMPLE 3

Preparation Of Thermographic Recording Materials

The coating dispersion for the thermosensitive element was produced by first allowing 3.44 g of K17881 to swell in 16.33 g of deionized water over a period of 30 minutes. 3.05 g of a first aqueous toning agent dispersion containing 18.08% of T01 and 9.95% of K17881 and 0.8 g of a second toning agent dispersion containing 20.12% of T02 and 8.88% of R16875 were then added and the resulting dispersion heated with stirring up to 50° C. 2 g of the above-mentioned dispersion of silver behenate were then added and after 10 minutes stirring a further 22.2 g of the same silver behenate dispersion were added and the resulting dispersion stirred for a further 10 minutes before 3.955 g of a 25.28% dispersion of LATEX01 was added. After a further 10 minutes stirring 2.222 g of 5.9% poly(itaconic acid) in water was added and after a further 10 minutes stirring, the resulting dispersion was cooled to 36° C. Finally, 18 g of deionized water was added and the dispersion stirred for a further 15 minutes. Shortly before coating 6 g of an aqueous ethanol solution containing 9.909% of R02 and 4.9% of S01 was added with stirring.

This coating dispersion at a temperature of 36° C. was then doctor-blade coated onto the non-backing layer side of the support used for the thermographic recording materials of COMPARATIVE EXAMPLES 1 to 4 and INVENTION EXAMPLES 1 and 2 to a wet coating weight of 72 g/m$^2$ and while undried was overcoated with 11 g/m$^2$ of an aqueous solution with 1.8% by weight of DVS-1 and 0.9091% by weight of Surfactant No. 1. Upon drying, the thermosensitive element of INVENTION EXAMPLE 3 was obtained.

Thermographic Evaluation

The thermographic recording material of INVENTION EXAMPLE 3 was printed and the maximum image density determined as described for the thermographic recording materials of COMPARATIVE EXAMPLES 1 to 4 and INVENTION EXAMPLES 1 and 2 except that during the thermographic printing the print head was separated from the imaging layer by a thin intermediate material separable from the thermographic recording material. This intermediate material consisted of a separable 5 μm thick polyethylene terephthalate ribbon coated successively with a subbing layer, heat-resistant layer and the slipping layer (anti-friction layer) giving a ribbon with a total thickness of 6 μm. The printing head was contacted with the slipping layer. The results for fresh material are given in Table 4.

Image evaluation was carried out as described for COMPARATIVE EXAMPLES 1 to 4 and INVENTION EXAMPLES 1 and 2. The a* and b* CIELAB-values of fresh prints of the substantially light-insensitive thermographic recording materials of INVENTION EXAMPLE 3 at an optical density, D, of 1.0 is also given in Table 4.

TABLE 4

| | | Image | Print with fresh material | | CIBLAB-values for print with fresh material | |
|---|---|---|---|---|---|---|
| Invention | AgB | tone | $D_{max}$ | $D_{min}$ | for D = 1 | |
| Example No. | g/m$^2$ | Stabilizer | vis | vis | a* | b* |
| 3 | 4.847 | — | 3.30 | 0.21 | −3.11 | −4.37 |

The $D_{min}$ values are mainly due to the density of the support, which had a $D_{vis}$ value of 0.19. The a*- and b*-values of prints made with fresh material are clearly acceptable, b* having a sufficiently negative value.

Archivability Tests

Simulated long-term archivability tests were performed as described for COMPARATIVE EXAMPLES 1 to 4 and INVENTION EXAMPLES 1 and 2. The prints were then evaluated as described above for prints of the corresponding fresh thermographic recording materials and the results are given in-Table 5.

TABLE 5

| Invention Example No. | Image tone stabilizer | print* after 4d 45°/70% RH $D_{max}$ vis | print* after 4d 45°/70% RH $D_{min}$ vis | CIELAB-values for print* after 4d 45° C./70% RH for D = 1 a* | CIELAB-values for print* after 4d 45° C./70% RH for D = 1 b* | ΔCIELAB-values versus fresh print* for D = 1 Δa* | ΔCIELAB-values versus fresh print* for D = 1 Δb* |
|---|---|---|---|---|---|---|---|
| 3 | — | 4.13 | 0.20 | −3.27 | −1.22 | +4.23 | −1.97 |

*material subjected to 7d at 45° C./70% RH prior to printing

Archival performance was assessed by monitoring the changes in a* and b* CIELAB values at D=1 of a print produced with a sheet of thermographic recording material, which had been heated in the dark for 7 days at 45° C. and 70% relative humidity prior to printing, over 4 days in the dark at 45° C. and 70% relative humidity. Acceptable archivability behaviour was observed as represented by Δa* and Δb* CIELAB values at D=1 which do not represent high positive or high negative shifts and a sufficiently negative final b*-value of −1.22.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A monosheet black and white substantially light-insensitive thermographic recording material comprising a thermosensitive element and a support, said thermosensitive element containing a substantially light-insensitive organic silver salt, an organic reducing agent therefore in thermal working relationship therewith and a binder, wherein said thermographic recording material comprises a reaction product of an amino-group-containing polymer and a compound according to formula (I):

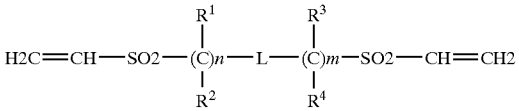

wherein each of $R^1$, $R^2$, $R^3$ and $R^4$ is independently hydrogen or an optionally substituted alkyl, aryl, heteroaryl, alkoxy or aryloxy group; L is a divalent linking group selected from the group consisting of oxygen and optionally substituted alkyl, aryl, heteroaryl, alkenyl and alkynyl groups; and m is either 0 or 1; and n is either 0 or 1.

2. Thermographic recording material according to claim 1, wherein said compound according to formula (I) is represented by formula (II):

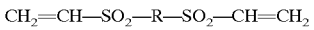

wherein R is a hydrocarbon group optionally substituted with an oxygen atom, the hydrocarbon group being optionally substituted with at least one alkoxy, alkyl, sulphonylvinyl or alkyleneoxyalkyl group.

3. Thermographic recording material according to claim 2, wherein R in formula (II) is an alkyl group with 1 to 6 carbon atoms.

4. Thermographic recording material according to claim 1, wherein said compound according to formula (I) is selected from the group consisting of: 1,1-bis-(vinylsulfonyl)methane, 1,2-bis-(vinylsulfonyl)ethane, 1,2-bis-(vinylsulfonyl)propane, 1,3-bis-(vinylsulfonyl)propane, 1,3-bis-(vinylsulfonyl)-2-hydroxy-propane, 3,3-bis-(vinylsulfonyl)-n-propyl-methyl-ether, tetrakis-(vinylsulfonylmethylene)-methane and 1,5-bis-(vinylsulfonyl)-3-oxy-n-pentane.

5. Thermographic recording material according to claim 1, wherein said amino-group-containing polymer is selected from the group consisting of gelatin and gelatin derivatives, melamine-formaldehyde resins, melamine-poly(vinyl alcohol) reaction products and urea-formaldehyde resins.

6. Thermographic recording material according to claim 1, wherein said reaction product in said thermographic recording material is substantially present in said thermosensitive element.

7. Thermographic recording material according to claim 1, wherein said thermosensitive element is provided with a protective layer.

8. Thermographic recording material according to claim 7, wherein said reaction product in said thermographic recording material is substantially present in said protective layer.

9. A process for coating a support with a thermosensitive element according to claim 1 comprising the steps of: applying a solution or dispersion containing said compound according to formula (I) to a support; and reacting said compound according to formula (I) with an amino-group-containing polymer, said compound according to formula (I) and said amino-group-containing polymer being either in the same layer or in immediately adjacent layers.

10. A process for the use of a compound according to formula (I):

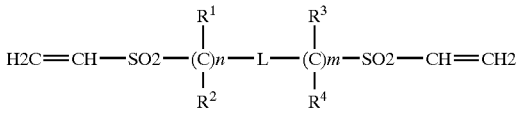

wherein each of $R^1$, $R^2$, $R^3$ and $R^4$ is independently hydrogen or an optionally substituted alkyl, aryl, heteroaryl, alkoxy or aryloxy group; L is a divalent linking group selected from the group consisting of oxygen and optionally substituted alkyl, aryl, heteroaryl, alkenyl and alkynyl groups; and m is either 0 or 1; and n is either 0 or 1, in the preparation of thermographic recording materials containing a substantially light-insensitive organic silver salt, comprising providing a support optionally having a backing layer on one side thereof; coating a side of said support without said optional backing layer with a thermosensitive element comprising said substantially light-insensitive organic silver salt; and optionally overcoating said thermosensitive element with a protective layer, wherein said backing layer and/or said thermosensitive element and/or said protective layer contain said compound according to formula (I).

11. A thermographic imaging process comprising the steps of: providing a monosheet black and white substantially light-insensitive thermographic recording material according to claim 1; and image-wise applying heat to said thermographic recording material under substantially water-free conditions.

* * * * *